US005172913A

United States Patent [19]

Bouquet

[11] Patent Number: 5,172,913

[45] Date of Patent: Dec. 22, 1992

[54] METAL WOOD GOLF CLUBHEAD ASSEMBLY

[76] Inventor: Harry Bouquet, 13582 Mindora Ave., Sylmar, Calif. 91342

[21] Appl. No.: 790,517

[22] Filed: Nov. 12, 1991

Related U.S. Application Data

[63] Continuation-in-part of Ser. No. 702,183, May 20, 1991, Pat. No. 5,076,585, and a continuation-in-part of Ser. No. 629,699, Dec. 17, 1990, abandoned, and a continuation-in-part of Ser. No. 351,835, May 15, 1989, abandoned.

[51] Int. Cl.[5] ..... A63B 53/04

[52] U.S. Cl. ..... 273/167 F; 273/167 H; 273/167 J; 273/169

[58] Field of Search ..... 273/167–175, 273/77 R, 77 A, 164, 194 B, 78, 79

[56] References Cited

U.S. PATENT DOCUMENTS

| | | | |
|---|---|---|---|
| 1,568,888 | 1/1926 | Dunn | 273/169 X |
| 2,395,837 | 3/1946 | Baymiller | 273/175 |
| 4,021,047 | 5/1977 | Mader | 273/167 H |
| 4,432,549 | 2/1984 | Zebelean | 273/167 H |
| 4,438,931 | 3/1984 | Motomiya | 273/167 H |
| 4,872,685 | 10/1989 | Sun | 273/169 |
| 4,930,781 | 6/1990 | Allen | 273/167 F |
| 5,028,049 | 7/1991 | McKeighen | 273/167 H |

FOREIGN PATENT DOCUMENTS

| | | | |
|---|---|---|---|
| 211781 | 12/1957 | Australia | 273/167 J |
| 2635688 | 3/1990 | France | 273/167 J |
| 1-190374 | 7/1989 | Japan | 273/167 R |
| 2016281 | 9/1979 | United Kingdom | 273/167 R |
| 2192795 | 1/1988 | United Kingdom | 273/167 R |

OTHER PUBLICATIONS

"Golf Digest" Magazine, Jul. 1965 issue, pp. 70–75.

*Primary Examiner*—Vincent Millin
*Assistant Examiner*—Sebastiano Passanti

[57] ABSTRACT

A metal wood type golf clubhead assembly is provided with a two-piece assembly; a forward metal forging which is weighted by using thick walls, and a rear metal fairing using thin walls. The weighting of the forward portion controls gear-effect and allows the use of a flat clubface.

2 Claims, 1 Drawing Sheet

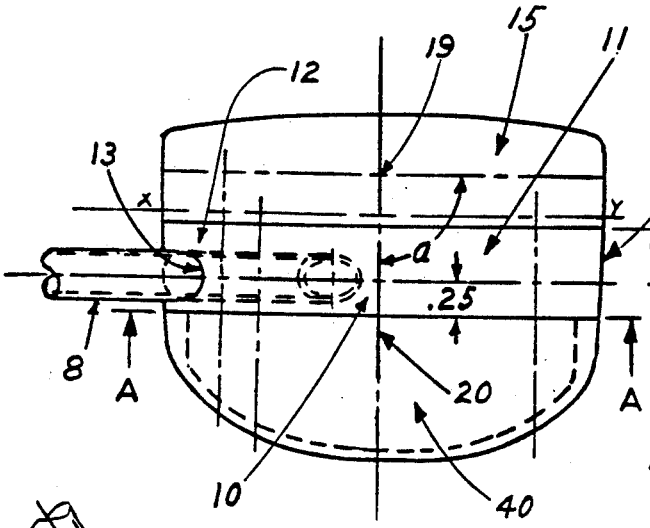
Fig. 1(a)
Fig. 1(c)
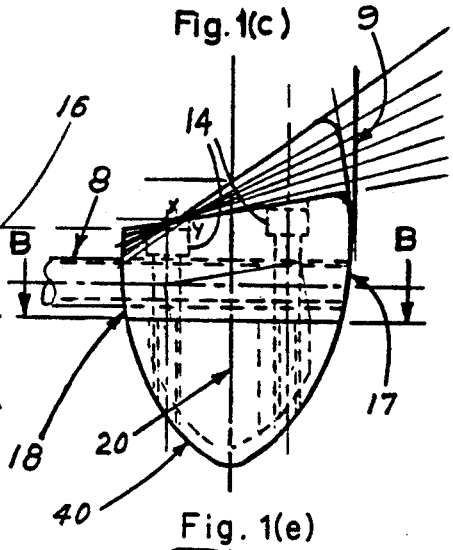
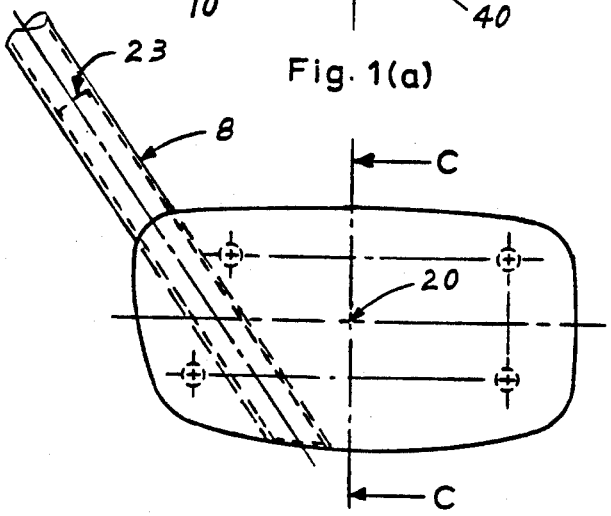
Fig. 1(b)
Fig. 1(e)
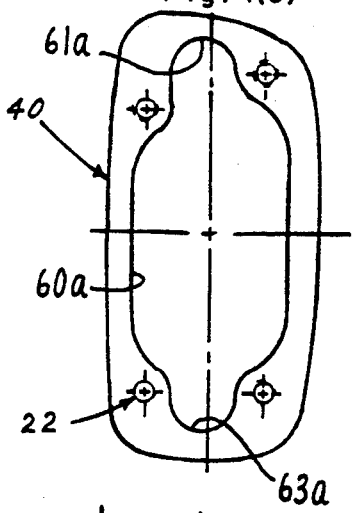
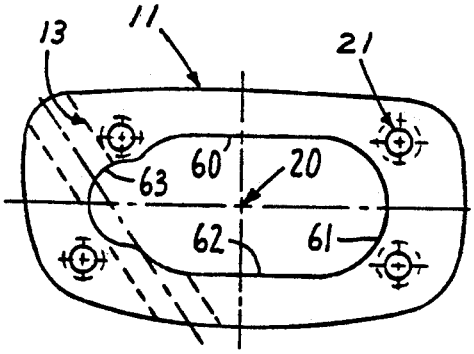
Fig. 1(d)
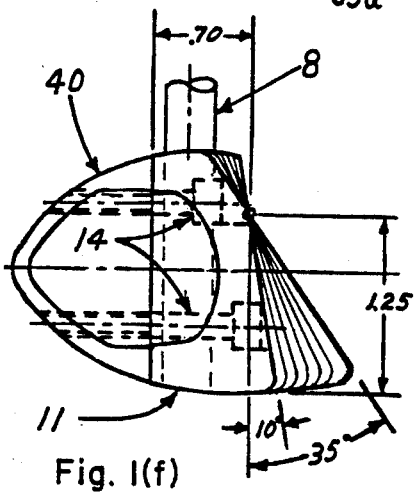
Fig. 1(f)

METAL WOOD GOLF CLUBHEAD ASSEMBLY

This application is a continuation-in-part of U.S. patent application Ser. No. 702,183, filed May 20, 1991 now U.S. Pat. No. 5,076,585; and Ser. No. 351,835, filed May 15, 1989, and now abandoned.

BACKGROUND OF THE INVENTION

In current wood golf clubs and in metal wood golf clubs, excessive side spin is generated to the ball on all off-center hits on the clubface. The resulting horizontal curve of the golf ball is usually called gear-effect and is an inherent characteristic for all golf clubs in which the weight distribution allows excessive rotation of the clubhead about its vertical axis through its center of gravity for all off-center impact with the golf ball.

Improper weight distribution and incorrect center of gravity location in any wood or metal wood type golf clubhead assembly requires the use of bulge radius to help correct for these deficiencies in golf clubhead designs.

Bulge radius is used as a side loft angle on the face of the wood and metal wood clubheads to start the ball further off the target line to correct for the excessive part of the gear-effect curve, and the ball will land on the fairway but with some loss in distance, due to the excessive side spin and curve.

The U.S.G.A. Rules of Golf reads "The face shall not have any degree of concavity." However, the rules allow a convex surface thus allowing bulge and roll radii and also a flat face.

A review of the major golf clubhead catalog for 1991 shows a total of twenty-four different designs of metal wood type golf clubheads and only three wood golf clubheads for a total of twenty-seven different designs and all twenty-seven list a bulge radius.

The need to use bulge radius to make these golf clubheads playable indicates that the current wood type metal golf clubs do not have, or do not claim, optimum weight distribution and a matched center of gravity location for the clubhead necessary to control gear-effect to the extent of being able to use a flat clubface.

The center of gravity distance measured from the the moment arm about which the clubface rotates for all off-center impact with the golf ball.

The high impact force and friction between the ball and the rotating clubface causes a horizontal spin component on the ball resulting in a horizontal curve in the flight of the golf ball called gear-effect.

When the moment arm or center of gravity distance is too great and not matched to the weight distribution of the clubhead, excessive horizontal spin is generated to the ball and the gear-effect is not adequately controlled and therefore bulge radius must be used on the clubface to make the golf club assembly playable.

The amount of bulge required to keep the ball on the fairway is determined by driving range tests. That is the procedure used to design present wood and metal wood type golf clubs.

All the designs reviewed to date use a bulge radius and also a roll radius.

SUMMARY OF THE INVENTION

This invention relates to golf clubs and primarily to metal wood type golf clubs designed to obtain optimum distance and accuracy for center and off-center hits on the clubface.

However, this metal golf clubhead design is also applicable for use with the shorter and heavier iron golf clubs such as listed in TABLE II.

Iron clubheads have too small a distance from their flat clubface to the back of the clubhead and their weight is concentrated too close to the clubface. The center of gravity distance or moment arm about which the clubface rotates for all off-center hits is too small to impart noticable gear-effect to the golf ball as the clubhead rotates at off-center impact, and the golf ball will not curve back toward the target line. The solution is to optimize the weight distribution in iron golf clubheads and obtain better accuracy by use of a golf clubhead with optimum weight distribution and matched center of gravity location such as claimed herein.

This objective requires that for each design of a golf clubhead the weight available be distributed to obtain the maximum practical mass moment of inertia about its vertical axis of rotation with a matched center of gravity which controls the gear-effect to the extent that allows for a flat clubface, the most efficient configuration allowed by the U.S.G.A. Rules of Golf.

For the selection of a suitable material for a practical size golf clubhead, one must consider (a) specific gravity or density, (b) modulus of elasticity or stiffness, (c) hardness and work-ability, (d) availability and (e) cost.

Most structural materials may be used in this design.

However, a commercial aluminum alloy was selected for the initial design due to its lightweight and adequate strength.

For hollow parts such as that for a wood type metal clubhead, the aluminum alloy clubhead can have a wall thickness three times that a stainless steel clubhead of the same size and weight. This allows for adequate working tolerances with a minimum afffect on the weight distribution and the center of gravity location.

The clubhead is made in two parts in order to be able to distribute the available clubhead weight in the most effective way in each part; featuring peripheral and optimum heel and toe weight distribution for the completed golf clubhead assembly. The two parts are attached together with four steel machine screws, accurately located in the heel and toe areas. The location of the steel attaching parts in the heel and toe areas helps maximize the mass moment of inertia of the aluminum alloy clubhead about its vertical axis of rotation.

Both clubhead parts can be investment castings or forgings to maintain accurate control of the size and weight distribution, and the matched center of gravity location.

BRIEF DESCRIPTION OF THE DRAWINGS

FIG. 1(*b*) is the view looking forward.

FIG. 1(*c*) is the view looking toward the toe of the clubhead.

FIG. 1(*d*) is a section on the line A—A of FIG. 1(a), and is looking forward into the clubhead to show the peripheral weight distribution in the forward metal forging 11, and the four drilled holes 21 for attaching it to the swingweight fairing 40.

FIG. 1(*e*) is a section on the line B-B of FIG. 1(c), and is a view looking aft into the fairing 40 to show peripheral weight distribution, and the four threaded holes 22 for the machine screws used to attach it to the clubhead structure 11.

FIG. 1(*f*) is a section on the line C—C of FIG. 1(*b*), and is a view through the center of the clubhead assembly to show that the only difference between golf clubheads Nos. 1 through 7 is the loft angle with the face plane located so that the additional weight required for the shorter golf clubs is in the extended lower area behind the face of the clubhead. This places the additional weight for the higher lofted clubs in the forward sole area of the clubhead, "to help get under the ball."

DETAILED DESCRIPTION OF THE DRAWINGS

Referring to the drawings, FIG. 1(a) shows a golf clubhead assembly shown generally as 10. The clubhead assembly 10 is a two-piece assembly which includes the forward metal forging 11 and the aft metal swingweight fairing 40. The four steel machine screws 14 to permanently install the two parts together are shown in FIG. 1(*c*) and in FIG. 1(*f*).

A heel portion 12 of the clubhead is adapted to receive a clubhead shaft 8 through cylindrical bore 13. A hardwood dowel 23 is bonded in golf shaft 8 to reinforce the shaft in the area where it is inserted and bonded into the clubhead as shown in FIG. 1(*b*).

A generally flat clubface 15 extends from heel 12 to the toe portion 16. A sole portion 17 forms the bottom of the clubhead assembly 10. The top 18 of the clubhead assembly is a smooth, convex surface generally found in golf clubheads.

The clubhead assembly 10 has a longitudinal axis 20 which extends horizontally as shown best in FIG. 1(*c*) when the clubhead is positioned with the sole portion 17 lying on the ground 9. As best shown in FIG. 1(*a*), the longitudinal axis 20 extends through the center 19 of the clubface 15. Longitudinal axis 20 forms a right angle a with clubface 15 when viewed from above as in FIG. 1(*a*).

The mating surfaces of the forward metal forging 11 and that of the metal swingweight fairing 40 is in a plane that is 0.25 inch behind the centerline plane of the golf clubshaft, as shown best in FIG. 1(*a*). The center of gravity of the metal clubhead assembly is designed to be located near the center plane of the golf shaft for the No. 1 driver with 10 degrees of loft.

The shape and weight distribution of the forward metal forging 11 is shown best in FIG. 1(*d*). The inside surface of forward metal forging 11 is bounded by upper wall 60, front wall 61, lower wall 62 and rear wall 63. The thickness of the walls in forward metal forging 11 is relatively thick for weighting and is such that forging 11 comprises 55% to 85% of the weight of the clubhead assembly, and the weight is evenly distributed around the periphery of the clubhead assembly, and around longitudinal axis 20, a shown in FIG. 1(*d*). The inside surface of metal fairing 40 is shown in FIG. 1(*e*), bounded by upper wall 60*a*, front wall 63*a*, bottom wall 62*a* and rear wall 61*a*. The wall thicknesses of metal fairing 40 are less than 50% of the wall thicknesses of forward metal forging 11.

As shown in FIG. 1(*d*), the weighting achieved by the thick walls 60–64 is uniformly distributed throughout the 360° around axis 20. My invention will work with the weight subtending an arc of at least 270° around axis 20, but the preferred design is a full 360° weighting.

The swingweight fairing 40 is designed to minimize the air drag during the golf swing. Due to its size and weight distribution, it is effective in controlling the center of gravity distance from the flat face of the clubhead assembly.

The shape and weight distribution of the swingweight fairing 40 is shown best in FIGS. 1(*e*) and 1(*f*).

By distributing the weight of the clubhead assembly as shown, and locating two steel attaching screws in the heel area, and the other two steel attaching screws in the toe area, I have greatly increased the resistance of the clubhead assembly to rotation of the clubhead caused by off-center impact with the golf ball. I refer to this feature herein as increasing the "mass moment of inertia" to the practical maximum value for the weights of the golf clubheads shown in TABLE I and in TABLE II.

The mass moment of inertia about the vertical axis of rotation is a direct measure of the stability and playability of the golf clubhead assembly for distance and accuracy and its ability to control gear-effect.

The mass moment of inertia about the horizontal axis of rotation is a measure of the stability of the clubhead about its horizontal axis of rotation and its ability to reasonably control the height of the ball due to either low or high hits on the clubface.

Based on experience with same size wood golf clubs having optimum weight distribution, the required center of gravity range is estimated to be 0.60 to 0.70 inch from the finished clubface. This matched center of gravity range is for clubheads having a weight distribution that results in the maximum practical mass-moment of inertia attainable for approximately a 7.5 ounce clubhead assembly about its vertical axis through its center of gravity, and for different lengths golf clubs as shown in TABLE I and in TABLE II.

The actual center of gravity distance for the completed golf clubhead assembly is measured on a sharp edge device that obtains the actual distance of the center of gravity from the finished clubface.

This distance is measured and noted on a data sheet before the golf shaft is installed and bonded in the clubhead assembly. This data is also noted on a stick-on label placed on the shaft of the test golf club assembly.

The optimum center of gravity distance from the clubface is determined by actual driving range tests, using several test golf clubs with different center of gravity distances, but having the similar mass-moment of inertia or head weight distribution.

Once the correct center of gravity distance is determined for a given size and weight of golf clubhead assembly, then the design can be developed using a manufacturing production system that controls the size and weight distribution within the necessary tolerances.

It is believed that the use of forging tool and dies or use of investment castings for producing the aluminum alloy golf clubheads and the swingweight fairings will produce the close tolerance parts required.

Also a close tolerance drill fixture is necessary to insure that the swingweight fairing can be installed to any of the seven structural golf clubheads listed in TABLE I and in TABLE II.

The desirable features of this metal golf clubhead assembly are:

1. This is a simple two part metal golf clubhead assembly with a hollow aft part or fairing attached and bonded to the partially hollow forward metal forging with epoxy and four steel machine screws.

2. The two parts are close tolerance forgings designed so the internal shape of the clubhead assembly maximizes the distribution of the weight in the heel and toe areas, and also achieves the optimum center of gravity distance from the flat clubface, as necessary to control gear-effect.

3. Two sets of seven matched metal wood type golf clubs No. 1 through No. 7 can easily be designed in accordance with the values listed in TABLE I and in TABLE II. The metal clubheads for each set are made the same externally except for the loft angle and the extended clubface, which provides the required weight for each length of golf club for the D2 swingweight calibration.

4. The above similarity decreases the tooling costs of the forging dies and tools.

5. The aft structural fairing is identical externally for all of the clubhead assemblies. However due to the appreciable differences in the clubhead weights listed in TABLES I and II, the weight and internal weight distribution of the fairings will also vary, in order to maintain the necessary center of gravity distance from the clubface.

6. The streamline fairing can be a forging with peripheral weight distribution with pads in the heel and toe areas for the four threaded holes used to attach it to the forward structural metal clubhead. It is drilled and threaded using a precision drill fixture to make it interchangeable and it may be used in all of the golf clubhead assemblies listed in TABLE I and in TABLE II.

7. No swingweighing weight changes are anticipated once production type tools are used to control the weights and weight distribution of the two parts. The weight of the clubhead assembly can be reduced most effectively by removing material from the flat clubface. This also reduces the center of gravity distance.

8. After the final swingweight calibration is completed to obtain the desired swingweight reading, the two parts are permanently assembled and bonded together using a thin coat of bonding epoxy on the mating surfaces and on all surfaces of the holes, threads and on all four attaching machine screws; which are then tightened to the proper installation torque.

9. The golf clubhead structure is simplified by eliminating the hosel. This decreases the air drag and allows that all of the clubhead weight be applied within the clubhead where it is most effective in stabilizing the clubhead for all off-center impact with the golf ball. In addition there is no possibility of shanking the golf ball with the hosel removed.

10. The hole drilled in the heel of the clubhead for installing the golfshaft pierces the sole surface and provides adequate length for bonding the golfshaft to the clubhead.

11. The lower end of the golfshaft is reinforced internally to compensate for the lack of a hosel by bonding a hardwood dowel within the shaft to reinforce it for about three inches within its lower end terminating at the sole surface.

TABLE I

DATA FOR SET OF SEVEN GOLF CLUBS OF OPTIMUM WEIGHT DISTRIBUTION

| CLUB NO. | HEAD WT. OZ. | LOFT ANGLE DEG. | LIE ANGLE DEG. | CLUB HD. C.G. IN. | CLUB LENGTH IN. |
|---|---|---|---|---|---|
| 1 | 7.02 | 10 | 54 | 0.65 | 43 |
| 2 | 7.23 | 14 | 54 | | 42.5 |
| 3 | 7.44 | 18 | 54 | | 42 |
| 4 | 7.66 | 22 | 55 | | 41.5 |
| 5 | 7.87 | 26 | 55 | | 41 |
| 6 | 8.08 | 30 | 56 | | 40.5 |
| 7 | 8.29 | 35 | 56 | 0.65 | 40 |

TABLE II

GOLF CLUB SPECIFICATIONS FOR IRONS INDUSTRY AVERAGES

| IRON CLUB NO. | HEAD WT. OZ. | LOFT ANGLE DEG. | LIE ANGLE DEG. | CLUB LENGTH LADIES IN. | CLUB LENGTH MENS IN. | CLUB HD. C.G. IN. |
|---|---|---|---|---|---|---|
| 1 | 8.01 | 17 | 56 | 38.5 | 39.5 | 0.65 |
| 2 | 8.25 | 20 | 57 | 38.0 | 39.0 | |
| 3 | 8.50 | 23 | 58 | 37.5 | 38.5 | |
| 4 | 8.75 | 26 | 59 | 37.0 | 38.0 | |
| 5 | 9.00 | 30 | 60 | 36.5 | 37.5 | |
| 6 | 9.25 | 34 | 61 | 36.0 | 37.0 | |
| 7 | 9.50 | 38 | 62 | 35.5 | 36.5 | 0.75 |

What is claimed is:

1. In a golf clubhead assembly wherein a hollow metal clubhead has a heel portion, drilled to receive a tubular clubshaft, a flat clubface extending from said heel to a toe portion, a sole forming a bottom of said clubhead, and a smooth, convex surface forming a top of said clubhead, and wherein said clubhead assembly has a longitudinal axis extending horizontally through the vertical center of said clubface, the improvement comprising:

a forward metal forging forming said clubface and for receiving a tubular clubshaft, said metal forging having uniformly thick walls for weighting; said thick walls subtending an arc of at least 270° about said longitudinal axis, the weight of said forward metal forging comprising 55% to 85% of the total weight of said clubhead assembly, said clubface having no bulge or roll radius and a metal fairing having walls forming a rear portion of said clubhead assembly, the walls of said fairing having a thickness less than 50% of said thick walls of said forward metal forging, whereby the center of gravity of said clubhead is located between 0.6 and 0.7 inches rearwardly from said clubface.

2. The clubhead assembly of claim 1 wherein said thick walls of said forward metal forging subtend an arc of 360° around said longitudinal axis.

* * * * *

UNITED STATES PATENT OFFICE

CERTIFICATE OF CORRECTION

Patent No. 5,172,913 Dated December 22, 1992

Inventor(s) Harry Bouquet

It is certified that error appears in the above-identified patent and that said Letters Patent is hereby corrected as shown below:

Col. 1, line 44, before the second "the" insert the words --clubface is--

Under the heading BRIEF DESCRIPTION OF THE DRAWINGS insert --Fig. 1(a) is the view looking down.--

Signed and Sealed this

Thirtieth Day of November, 1993

Attest:

Bruce Lehman

BRUCE LEHMAN

Attesting Officer

Commissioner of Patents and Trademarks